US009409732B2

(12) United States Patent
Tojima et al.

(10) Patent No.: US 9,409,732 B2
(45) Date of Patent: Aug. 9, 2016

(54) SHEET-LIKE OBJECT TRANSPORTING DEVICE AND INK-JET PRINTER

(71) Applicant: RISO KAGAKU CORPORATION, Minato-ku, Tokyo (JP)

(72) Inventors: Takahito Tojima, Tsukuba (JP); Masami Kanehira, Tsukuba (JP); Kenji Kudo, Tsukuba (JP)

(73) Assignee: RISO KAGAKU CORPORATION, Tokyo (JP)

( * ) Notice: Subject to any disclaimer, the term of this patent is extended or adjusted under 35 U.S.C. 154(b) by 0 days.

(21) Appl. No.: 14/827,900

(22) Filed: Aug. 17, 2015

(65) Prior Publication Data

US 2016/0060052 A1 Mar. 3, 2016

(30) Foreign Application Priority Data

Sep. 3, 2014 (JP) ..... 2014-179298

(51) Int. Cl.

| | |
|---|---|
| ***B41J 11/00*** | (2006.01) |
| ***B41J 11/42*** | (2006.01) |
| ***B65H 3/12*** | (2006.01) |
| ***B65H 7/20*** | (2006.01) |
| ***B65H 7/16*** | (2006.01) |

(52) U.S. Cl.

CPC ..... *B65H 3/126* (2013.01); *B41J 11/007* (2013.01); *B41J 11/0085* (2013.01); *B41J 11/42* (2013.01); *B65H 7/16* (2013.01); *B65H 7/20* (2013.01)

(58) Field of Classification Search

CPC ..... B41J 11/007; B41J 11/0085; B41J 11/42
USPC ..... 347/4, 5, 101, 102, 104
See application file for complete search history.

(56) References Cited

U.S. PATENT DOCUMENTS

| | | | | |
|---|---|---|---|---|
| 5,966,203 | A * | 10/1999 | Bowen | A61M 1/008 355/73 |
| 5,992,994 | A * | 11/1999 | Rasmussen | B41J 2/01 347/104 |
| 8,308,287 | B2 * | 11/2012 | Ebihara | B41J 2/155 347/101 |
| 8,353,591 | B2 * | 1/2013 | Isowa | B41J 3/407 347/101 |
| 8,634,751 | B2 * | 1/2014 | Moteki | G03G 15/657 399/322 |
| 8,733,924 | B2 * | 5/2014 | Yamagishi | B41J 2/1714 271/267 |

FOREIGN PATENT DOCUMENTS

JP 2008-81317 A 4/2008

* cited by examiner

*Primary Examiner* — Anh T. N. Vo
(74) *Attorney, Agent, or Firm* — Manabu Kanesaka

(57) ABSTRACT

A sheet-like object transporting device disclosed herein includes a transport plate having suction holes made penetrating therethrough, a fan that sucks in air through the suction holes, a belt that moves along an upper surface of the transport plate, and a controller. Width of the belt corresponds to width of the transport plate. The belt has an open zone whose form corresponds to a sheet-like object. A sheet-like object is loaded on the transport belt so as to close up the open zone. The belt is moved with the sheet-like object attracted onto it by suction. The sheet-like object is stably held onto the transport belt, contacting the peripheries of the open zone without misalignment, and is stably transported without moving out of position or upward. It is possible to transport a sheet-like object attracted onto the belt, while suppressing suction force wasting.

8 Claims, 10 Drawing Sheets

SHEET-LIKE OBJECT TRANSPORTING DEVICE AND INK-JET PRINTER

RELATED APPLICATIONS

The present application is based on, and claims priority from, Japanese Application No. JP2014-179298 filed Sep. 3, 2014, the disclosure of which is hereby incorporated by reference herein in its entirety.

TECHNICAL FIELD

The present invention relates to a sheet-like object transporting device that transports a sheet-like object (that is stiff), while holding it by suction, and an ink-jet printer using the sheet-like object transporting device. The present invention relates particularly to a sheet-like object transporting device that is capable of transporting a sheet-like object, while securely holding it by using suction force without waste, so that the sheet-like object will not move out of position.

BACKGROUND OF ART

A sheet-like object transporting device that transports a stiff sheet-like object S such as a corrugated fiberboard and a cardboard, while holding it by suction, is known. Such a sheet-like object transporting device is often used in an ink-jet printer or the like. FIGS. 8A and 8B are schematic diagrams for explaining the structure and workings of a suction-type sheet-like object transporting device of related art. As depicted in FIGS. 8A and 8B, two transport belts 102 which are narrow in width are placed in parallel with each other on the upper surface of a transport plate 101 with numerous holes 100 made penetrating through it and the belts are allowed to move, circulating along a transport direction. Beneath the transport plate 101, a suction means is provided which sucks in air, as functionally indicated by arrows, though it is not depicted. When a sheet-like object S is transported, the sheet-like object S loaded on a pair of transport belts 102 is held on the surface of the transport belts by being sucked by the suction means through the holes 100 of the transport plate 101 and transported with the move of the transport belts 102.

In Japanese Unexamined Patent Application Publication No. 2008-81317, an invention of an image forming apparatus is disclosed. This image forming apparatus includes a transport mechanism 1 for transporting a recoding medium 20 that is a sheet-like object. Although the sheet-like object in Japanese Unexamined Patent Application Publication No. 2008-81317 is not limited to a stiff sheet-like object, the transport mechanism is also applicable to paper that is rather stiff. According to the transport mechanism 1 of this image forming apparatus, a transport belt 5 has numerous holes 5*a* made through it and the transport belt 5 moves along a transport surface of a platen 31 with numerous holes 31*a* made penetrating through it, as depicted in FIGS. 4 and 6 in the above publication. A platen frame 32 in which a suction fan 41 is installed is provided beneath the underside of the platen 31. When a recording medium 20 is transported, the recording medium 20 which is a sheet-like object S is attracted to the surface of the transport belt 5 by being sucked by the suction fan 41 through the holes 31*a* of the platen 31 and the holes 5*a* of the transport belt 5 and transported with the move of the transport belt 5.

SUMMARY OF INVENTION

Technical Problem

According to the suction-type sheet-like object transporting device of related art depicted in FIGS. 8A and 8B, holes 100 for suction are formed over almost the entire surface of the transport plate 101 and a pair of transport belts 102 which are narrow in width is configured to move in contact with portions of the surface of the transport plate other than regions where these holes 100 are formed. A sheet-like object S loaded on these transport belts 102 is sucked and held onto the transport belts 102 and transported by moving the transport belts 102. Accordingly, suction holes 100 contacting the sheet-like object S give effective force sucking the sheet-like object, as indicated by arrows V1 in the drawings. However, suction holes 100 not contacting the sheet-like object S are only the holes through which air flows in, as indicated by arrows V2 in the drawings, and do not work to generate force sucking the sheet-like object S, which results in a decrease in the force sucking the sheet-like object S. Consequently, if that sheet-like object transporting device is used in an ink-jet printer, there is a possibility that a sheet-like object S moves out of position during its transportation, which might cause damage to an ink-jet head that performs printing or ink smudges during its transportation.

According to the transport mechanism that transports a sheet-like object held by suction as disclosed in Japanese Unexamined Patent Application Publication No. 2008-81317, because of the use of a transport belt having a wider shape covering almost the entire surface of the transport plate than the suction-type sheet-like object transporting device of related art depicted in FIG. 8 and with multiple suction holes made through the belt, a decrease in the suction force can somewhat be reduced. However, air flowing in through suction holes not contacting a sheet-like object cannot be stopped and it is difficult to obtain sufficient force sucking a sheet-like object.

As just described, in the transport mechanism that transports a sheet-like object held by suction, when the suction force holding a sheet-like object decreases, a sheet-like object which is held insufficiently may move out of position during its transportation. In a case where the above mechanism is used as a transport mechanism of an image forming apparatus (ink-jet printer), the sheet-like object might collide with and damage an ink-jet head and components located around the sheet-like object might be smudged with ink.

To prevent such a decrease in the suction force in the transport mechanism that transports a sheet-like object held by suction, it is conceivable to increase the output of the suction fan to solve this problem. However, doing so poses another problem in which a larger fan is required and, in turn, larger energy is needed.

The present invention has been made in view of related art techniques and associated problems as noted above and is intended to provide a sheet-like object transporting device that transports a stiff sheet-like object, while holding it by suction, the device being capable of transporting a sheet-like object, while securely holding it, by making effective use of suction force, while suppressing its wasted consumption.

Solution to Problem

According to a first aspect of the present invention, a sheet-like object transporting device that transports a sheet-like object, while holding it by suction includes the following:

a transport plate having a plurality of suction holes made penetrating through it;

a suction unit that is provided beneath the transport plate and sucks in air through the suction holes;

a transport belt that is provided so as to be movable along an upper surface of the transport plate and has an open zone with a length suitable for the sheet-like object;

a driving unit that moves the transport belt along the upper surface of the transport plate in a transport direction; and a controller that controls the driving unit so that a sheet-like object will be transported in a state in which the sheet-like object covers over the open zone.

A second aspect of the present invention resides in the sheet-like object transporting device according to the first aspect, characterized in that:

one or more transport belts are arranged in parallel with a sheet transport direction depending on width of the sheet-like object, each transport belt having one or more open zones formed in parallel with the sheet transport direction, and the device as a whole having two or more open zones; and width of an open zone region covering over the two or more open zones is set to correspond to the width of the sheet-like object.

A case where there is only one transport belt having two or more open zones and a case where two or more transport belts are used, each transport belt having one open zone, are included in the second aspect.

A third aspect of the present invention resides in the sheet-like object transporting device according to the second aspect, characterized in that length of the open zones of the transport belts in the sheet transport direction is adjustable.

A fourth aspect of the present invention resides in an ink-jet printer including an ink-jet head which prints on the upper surface of a sheet-like object, provided in a path along which the sheet-like object is transported by the sheet-like object transporting according to the first aspect.

A fifth aspect of the present invention resides in an ink-jet printer including an ink-jet head which prints on the upper surface of a sheet-like object, provided in a path along which the sheet-like object is transported by the sheet-like object transporting according to the second aspect.

A sixth aspect of the present invention resides in an ink-jet printer including an ink-jet head which prints on the upper surface of a sheet-like object, provided in a path along which the sheet-like object is transported by the sheet-like object transporting according to the third aspect.

Advantageous Effects of Invention

According to the sheet-like object transporting device in the first aspect of the present invention, if suction holes of the transport plate are covered by a portion of the transport belt without the open zone, the suction holes are closed up and put in a state in which they cannot suck in air, whereas, suction holes in the open zone of the transport belt are exposed and, thus, put in a state they can suck in air. When transporting a sheet-like object by this sheet-like object transporting device, the driving unit is controlled in time with transporting the sheet-like object so that the entire sheet-like object from its forward edge to its rear edge will close up the open zone. The sheet-like object is attracted to the open zone of the transport belt, while it is in contact with the peripheries of the open zone without misalignment and stably held onto the transport belt. The sheet-like object is stably transported with the move of the transport belt without moving out of position or upward. Suction holes other than the suction holes serving to hold the sheet-like object onto the transport belt are closed up by the transport belt. Thus, it is avoided that the suction force of the suction unit is used wastefully.

According to the sheet-like object transporting device in the second aspect of the present invention, two or more open zones provided make it possible to increase the belt strength by distributing tensile loading which acts on the peripheries of belt open zones and enhance stability of transportation.

According to the sheet-like object transporting device in the third aspect of the present invention, it is possible to adjust the length of the open zones of the transport belts in the sheet transport direction depending on the length of a sheet-like object to be transported in the transport direction. Accordingly, it would become possible to transport sheet-like objects of diverse sizes by one sheet-like object transporting device.

According to the ink-jet printer in the fourth aspect of the present invention, it is possible to transport a sheet-like object held sufficiently, while saving energy consumed by a suction fan. It can be prevented that a sheet-like object moves out of position as it is transported, an ink-jet head is damaged, or peripheral components are smudged with ink.

According to the ink-jet printer in the fifth aspect of the present invention, two or more open zones provided make it possible to increase the belt strength by distributing tensile loading which acts on the peripheries of belt open zones, enhance stability of transportation, and enhance accuracy of printing.

According to the ink-jet printer in the sixth aspect of the present invention, it is possible to adjust the length of the open zones of the transport belts in the sheet transport direction depending on the length of a sheet-like object to be transported in the transport direction and it would become possible to perform printing on sheet-like objects of diverse sizes.

DESCRIPTION OF EMBODIMENTS

1. First Embodiment

FIGS. 1 to 6

A sheet-like object transporting device 1 of a first embodiment and an ink-jet printer using the sheet-like object transporting device 1 are described with reference to FIGS. 1 to 6.

Figure 5:
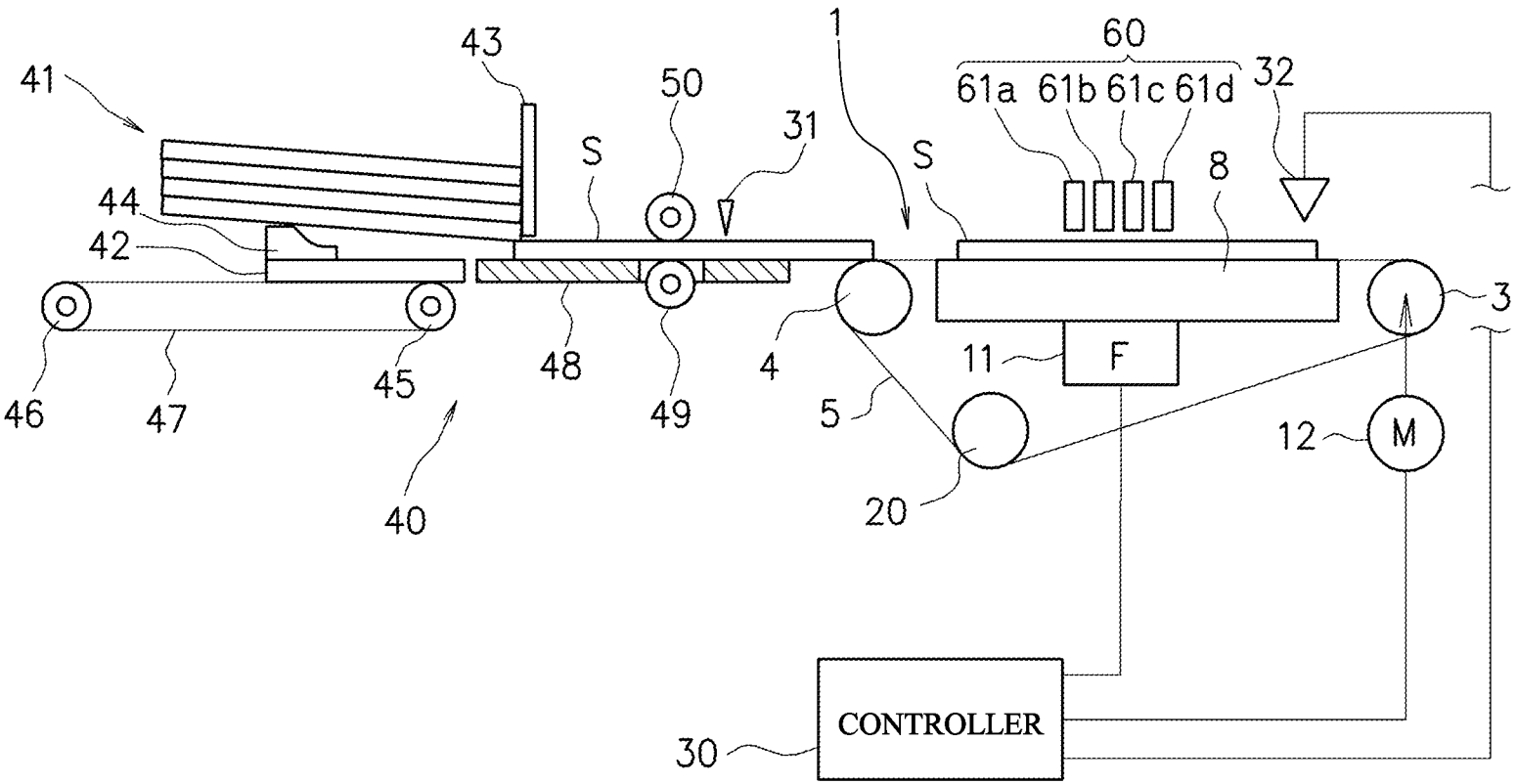
FIG. 5 is a schematic diagram depicting an overall structure of an ink-jet printer using the sheet-like object transporting device of the first embodiment and, inter alia, a controller.

The sheet-like object transporting device 1 of the present embodiment can be used as a device for transporting a sheet-like object on which an image is to be printed in an image forming apparatus such as an ink-jet printer, as is depicted in FIG. 5, which will be described later. In that case, as the sheet-like-object, a sheet-like object that is thick and highly stiff, like, e.g., a corrugated fiberboard and a cardboard, is preferable. Attracting and transporting a sheet-like object can be performed securely and stably and it is possible to prevent such a trouble that a corrugated fiberboard or a cardboard moves upward during its transportation and damages an image forming means such as an ink-jet head. Thus, there is a high merit of adopting the sheet-like object transporting device 1 of the present embodiment.

As an object on which an image is to be printed and for which convenience of adopting the sheet-like object transporting device 1 of the present embodiment is especially high, the following kinds of paper are applicable: corrugated fiberboards with a thickness range of approx. 2 mm to 12 mm and cardboards which are as thick as a sheet of drawing paper, e.g., paper of 200 GSM (g/m$^2$) or more.

First, a principal structure of the sheet-like object transporting device 1 of the first embodiment is described with reference to FIGS. 1 to 4. A sheet feeder which feeds a sheet one by one to the sheet-like object transporting device 1 and an image forming unit will be described later with FIG. 5.

The sheet-like object transporting device 1 is a transport device of a belt conveyor type which is provided with a chassis-like frame 2 in which a belt conveyor and other components are assembled. At both ends of the frame 2 with respect to a direction of transporting a sheet-like object (sheet transport direction), which is indicated by an arrow V3 in FIGS. 1 to 3, a driving roller 3 and a driven roller 4 of a belt conveyor are rotatably installed so as to be parallel with each other. In the present invention, each of the driving roller 3 and the driven roller 4 is comprised of two rollers of the same length which are jointed coaxially. This is arranged so that the number of rollers which are jointed coaxially can be set arbitrary depending on the width of a sheet-like object to be transported. Therefore, depending on the width of a sheet-like object to be transported, one roller may be used or more than three rollers may be jointed and used.

Figure 1:
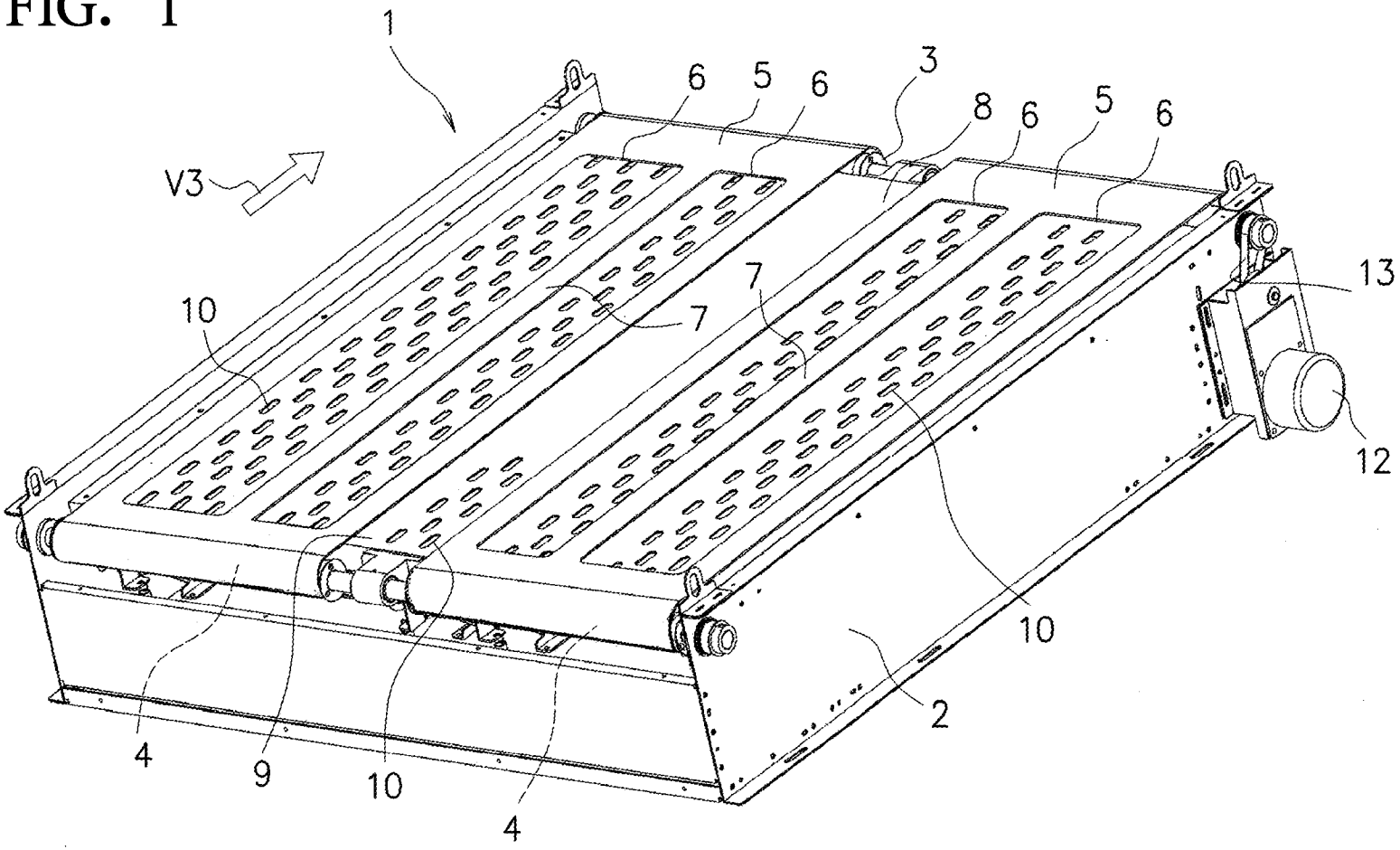
FIG. 1 is a perspective view of a principal part of sheet-like object transporting device of a first embodiment.
Figure 2:
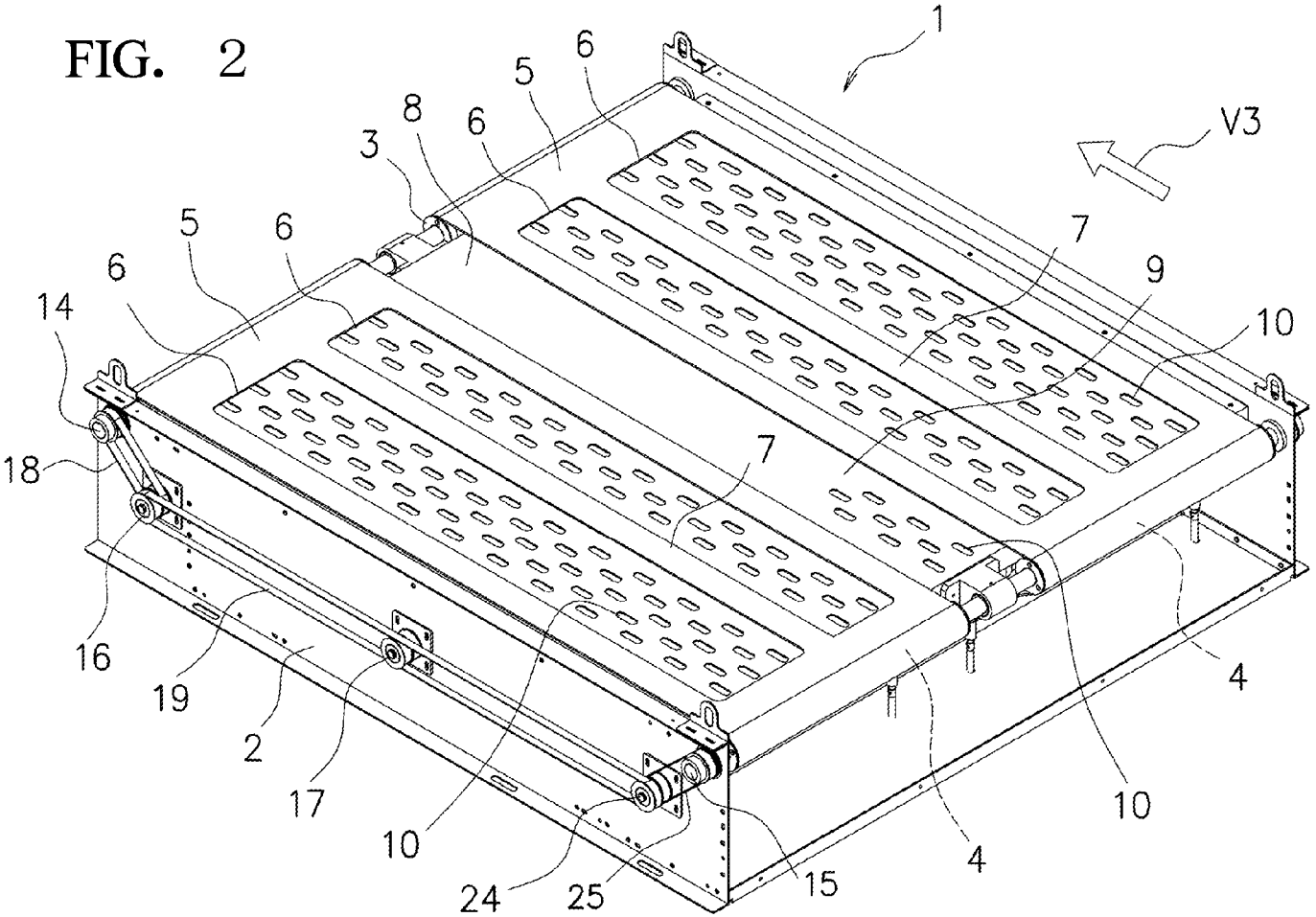
FIG. 2 is a perspective view of the sheet-like object transporting device of the first embodiment, when viewed from a direction opposite to that in FIG. 1.

As depicted in FIGS. 1 and 2, a transport belt 5 is stretched between the driving roller 3 and the driven roller 4. It is preferable that the transport belt 5 has a thickness of approx. 2 to 3 mm, if it transports, e.g., corrugated fiberboards with relatively high stiffness, though its thickness depends on, inter alia, the material and size of a sheet-like object to be transported. As the belt material, elastomer can be used.

The transport belt 5 in the present embodiment is comprised of two transport belts 5 separated with respect to the axial direction of both rollers 3, 4 (i.e., a width direction orthogonal to the sheet transport direction within a plane). That is, each of the two transport belts 5 corresponds to each of the pairs of rollers constituting the driving roller 3 and the driven roller 4.

As depicted in FIGS. 1 and 2, each transport belt 5 has an open zone 6 with a length suitable for a sheet-like object to be transported. In the present embodiment, each transport belt 5 has a pair of two open zones 6 separated by a central bridge portion 7, as depicted in FIGS. 1 and 2. In the adjacent two transport belts 5, the positions of the respective open zones 6 are set corresponding to each other with respect to the sheet transport direction. Although the open zones 6 are rectangles in the example depicted, if the corners of the rectangles are rounded to make the open zones into a rather oblong form, the strength of the transport belt 5 against tensile force will be improved and the belt will be harder to break.

Length (a dimension in the sheet transport direction) of each open zone 6 is substantially equal to the length of a sheet-like object which is transported. It is preferable that the length of each open zone 6 is slightly shorter than that of a sheet-like object which is transported. However, a case where that length is slightly longer shall be included in the present invention.

Assuming a virtual open zone region covering over the four open zones 6 (a minimum rectangular region covering over the open zones 6), the width of this open zone region (a dimension in a direction orthogonal to the sheet transport direction) is substantially equal to the width of a sheet-like object which is transported. It is preferable that the width of the open zone region is slightly shorter than the width of a sheet-like object which is transported. However, a case where that width is slightly longer shall be included in the present invention. The number of open zones which are formed in one transport belt 5 is determined by the width of a sheet-like object (a dimension in a direction orthogonal to the sheet transport direction) and the width and material of a transport belt 5 among others. Although a transport belt 5 may have one open zone formed in the sheet transport direction, two open zones are formed in parallel with the sheet transport direction in the embodiment depicted in FIGS. 1 and 2. In a transport belt 5, of course, more than two open zones may be formed in parallel with the sheet transport direction.

Because it is comparatively easy to replace the transport belts 5, a plurality of sets of transport belts 5 with open zones of different dimensions for each set may be prepared beforehand and a set of transport belts 5 whose open zone dimensions are suitable for the dimensions of a sheet-like object to be transported may be selected and set in each case.

As depicted in FIGS. 1 to 4, in the frame 2, a suction box 8 is installed as a suction part between the driving roller 3 and the driven roller 4. The suction box 8 is a thin box body and its upper surface defines a transport plate 9 on which the transport belts 5 stretched between the driving roller 3 and the driven roller 4 slide. That is, the transport plate 9 of the suction box 8 is a plane that guides the transport belts 5 and is placed horizontally in a position that is slightly lower than a plane leveled with the generatrices of the apices of the driving roller 3 and the driven roller 4, taking the thickness of the transport belts 5 into account.

As depicted in FIGS. 1, 2, 3A, 4A, and 4B, the transport plate 9 of the suction box 8 has numerous suction holes 10 made penetrating through it. The suction holes 10 have a rectangular form with round four corners or an oblong form and are formed to be spaced at given intervals in the transport direction and in a staggered arrangement in the width direction. As depicted in FIGS. 1 and 2, these suction holes 10 are formed over almost the entire surfaces of two regions where two transport belts 5 are placed and which are respectively covered by the two transport belts 5.

Figure 3:
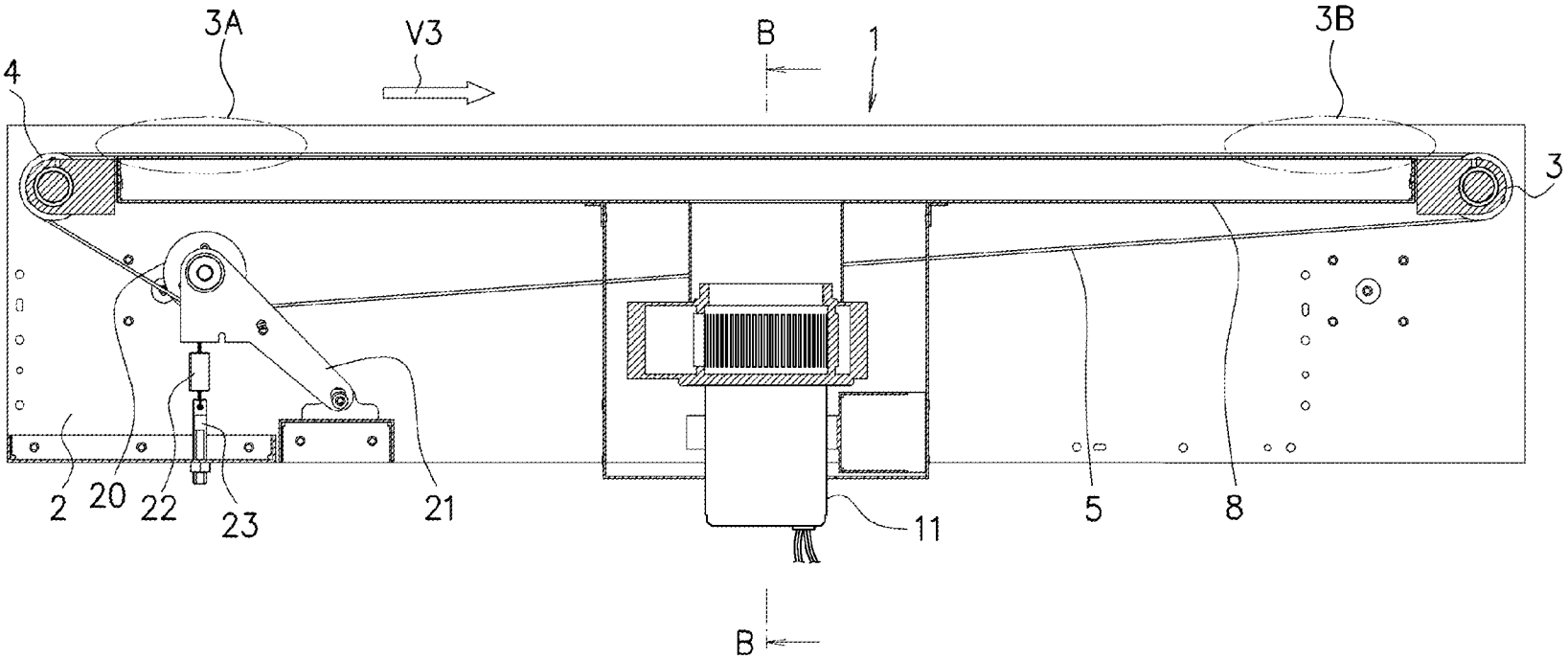
FIG. 3 is a cross-sectional view through a vertical plane (section A-A in FIG. 4), which is parallel to a transport direction, of the sheet-like object transporting device of the first embodiment.
Figure 3A:
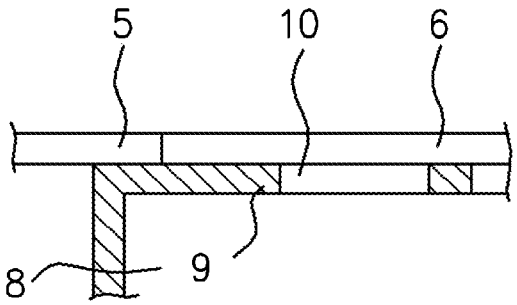
FIG. 3A is an enlarged view of a part 3A in FIG. 3.
Figure 3B:
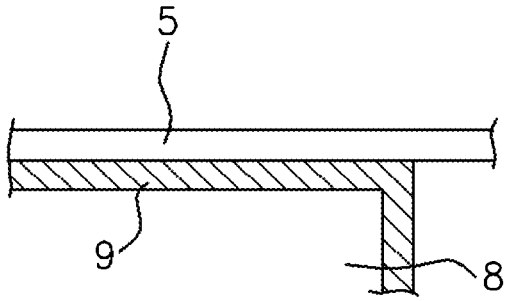
FIG. 3B is an enlarged view of a part 3B in FIG. 3.

As depicted in FIGS. 1, 2, and 3A, suction holes 10 are also formed in a portion that is upstream with respect to the transport direction within a region not covered by the transport belts 5, namely, a region between the two regions covered by the transport belts 5. These transport holes 10 are formed to help suctioning a leading portion of a sheet-like object when it is guided into the present device 1 at an upstream side until suction through the open zones 6 of the transport belts 5 becomes stable.

Figure 4:
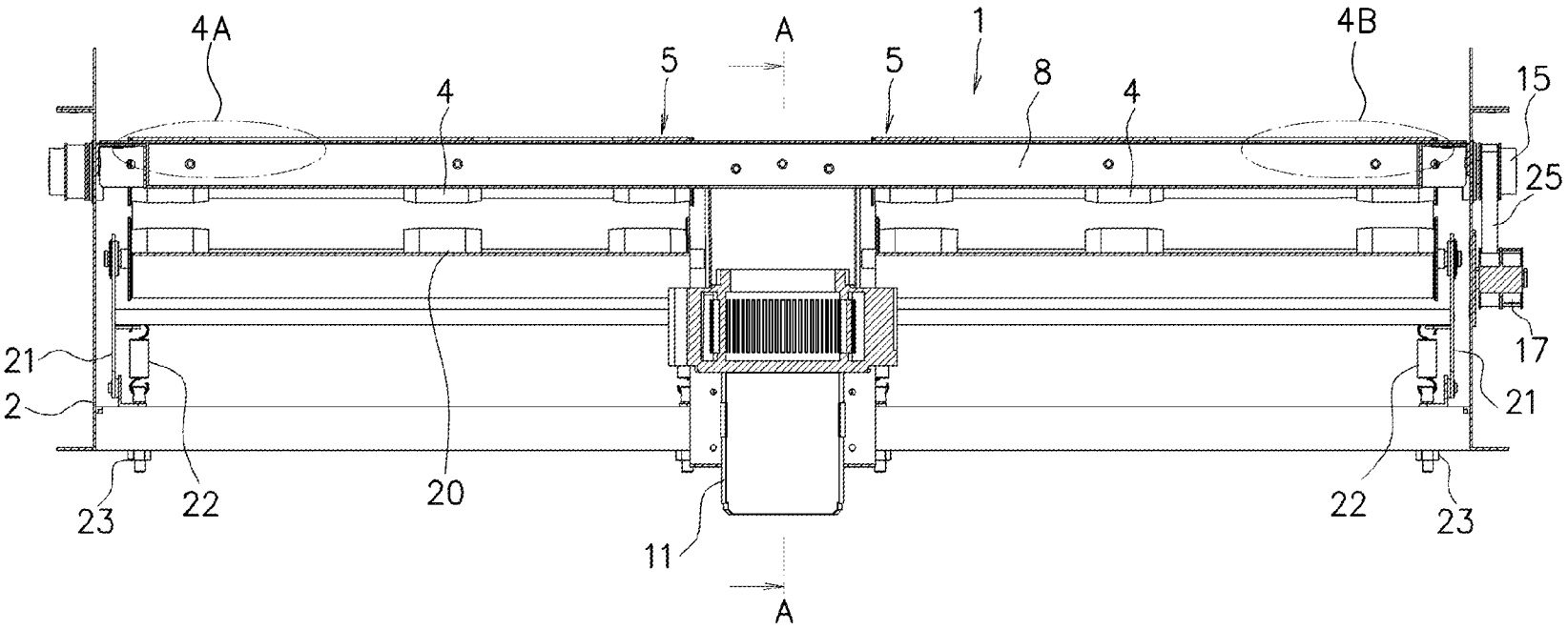
FIG. 4 is a cross-sectional view through a vertical plane (section B-B in FIG. 3), which is orthogonal to the transport direction, of the sheet-like object transporting device of the first embodiment.
Figure 4A:
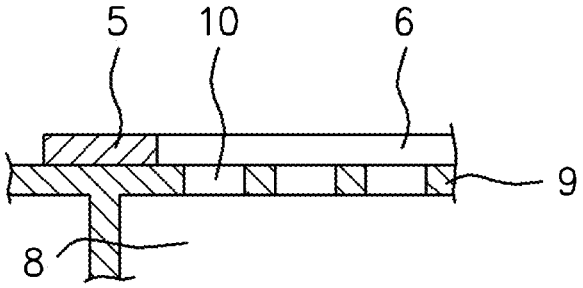
FIG. 4A is enlarged view of a part 4A in FIG. 4.
Figure 4B:
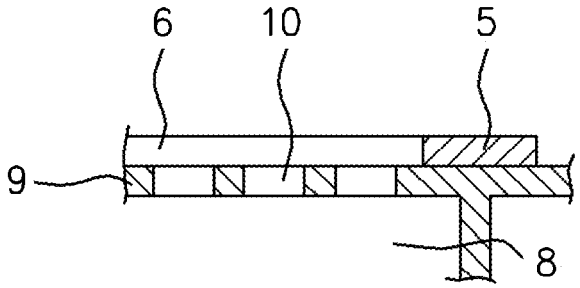
FIG. 4B is enlarged view of a part 4B in FIG. 4.

As depicted in FIGS. 3 and 4, a Sirocco fan 11 which is a fan for suction as a suction means is provided beneath the underside of the suction box 8 with the transport plate 9 having the suction holes 10. As this Sirocco fan 11 sucks in air inside the suction box 8, air is sucked into the suction box 8 through the suction holes 10.

As depicted in FIG. 1, a motor 12 is installed on one lateral side of the frame 2 as a driving unit that moves the transport belts 5 along the upper surface of the transport plate 9 in the sheet transport direction. A drive shaft of the motor 12 is linked to a drive axis of the driving roller 3 through a drive belt 13 for interlock operation.

As depicted in FIG. 2, an interlock mechanism which interlocks the driving roller 3 and the driven roller 4 is provided on another lateral side of the frame 2. This interlock mechanism includes a driving pulley 14 installed on the drive axis of the driving roller 3, a driven pulley 15 installed on the driven axis of the driven roller 4, three intermediate pulleys 16, 17, and 24 provided on another lateral side mentioned above of the frame 2, a first belt 18 which interlocks the driving pulley 14 and a first intermediate pulley 16 (lower tier), a second belt 19 which interlocks the first intermediate pulley 16 (upper tier) and a third intermediate pulley 24 (upper tier) via a second intermediate pulley 17, and a third belt 25 which interlocks the third intermediate pulley 24 (lower tier) and the driven pulley 15. The intermediate pulley 16 is a double-tier pulley in which two pulleys are fixedly installed on the same axis and is made capable of conveying drive force conveyed from the driving axis 14 via the first belt 18 to the third intermediate pulley 24 via the second belt 19. The intermediate pulley 17 serves as a tensioner and is configured to apply tension to the underside of the belt 19 (its detail is omitted from depiction). Like the intermediate pulley 16, the intermediate pulley 24 is also a double-tier pulley in which two pulleys are fixedly installed on the same axis and is configured to convey drive force conveyed via the second belt 19 to the driven pulley 15 via the third belt 25, thus driving the driven roller 4 to turn.

As depicted in FIG. 3, the transport belt 5 (each) is stretched by a tension roller 20 located near and below the driven roller 4. The tension roller 20 is rotatably installed onto an upper part of a sway arm 21 and the sway arm 21 is urged in a direction to pull down the tension roller 20 by a spring 22 as an urging means. Urging force given by the spring 22 to the sway arm 21 and the tension roller 20 can be adjusted by turning a screw in a joint 23 that joins the spring 22 to the frame 2.

Then, referring to FIG. 5, descriptions are provided about a sheet feeder 40 which feeds sheets one by one to the sheet-like object transporting device 1 of the first embodiment and an image forming unit 60 as well as control of the sheet-like object transporting device 1.

The sheet feeder 40 is provided on an upstream side of the sheet-like object transporting device 1. This sheet feeder may be any sheet feeder that can feed sheet-like objects one by one to the sheet-like object transporting device 1. While a heretofore known sheet feeder described in Japanese Unexamined Patent Application Publication No. 2011-213448 among others may be used, a sheet feeder for which the present applicant applied for a patent (Japanese Patent Application 2013-156412) shall be used here.

The sheet feeder 40 includes a hopper 41 which contains a plurality of sheet-like objects S stacked substantially horizontally. The hopper 41 is comprised of a sheet loading member 42, a front gate 43, and a pair of side fences (omitted from depiction) so as to be surrounded by them. On the top of the sheet loading member 42, a slant face kicker 44 whose forward end is formed to have a suitable height to push out one sheet-like object 1 is installed. The sheet loading member 42 is fixed to a chain 47 stretched between a driving-side sprocket 45 and a driven-side sprocket 46 and is made capable of reciprocating between a standby position in which the slant face kicker 44 retracts and a sheet feed position (a position depicted in FIG. 5) in which the slant face kicker 44 is put forward by being driven by positive and inverse rotation of the driving-side sprocket 45 which is driven by the motor.

A sheet guide plate 48 is fixed installed just forward of the sheet loading member 42 in the sheet transport direction. The sheet guide plate 48 is provided with a driving roller 49 on its underside nearly in the center. A driven roller 50 is installed above the driving roller 49 such that the driven roller 50 can come into and out of contact with the driving roller 49. The driving roller 49 and the driven roller 50 can be controlled to move one sheet-like object toward the sheet-like object transporting device. An arrangement is made such that, when the slant face kicker 44 is driven to move from the standby position to the sheet feed position, one sheet, which is the lowest one of stacked sheets in the hopper 41, is pushed out, passes through an opening formed at the lower end of the front gate 43, and is placed on the sheet guide 48. The slant face kicker 44 is made capable of pushing up sheet-like objects by its upper surface other than one sheet-like object that it brings out, when approaching the sheet feed position. Furthermore, a forward edge detecting sensor 31 which detects passage of the forward edge of a sheet-like object S is provided forward of the driven roller 50 in the sheet transport direction.

The sheet-like object transporting device 1 is provided with a controller 30 which controls a driving unit or the like so that a sheet-like object will be transported, covering over the open zones 6. A belt reference position sensor 32 to detect the reference position of the transport belt 5 is provided above a downstream end portion of the present device. An arrangement is made such that a sheet detection signal from the forward edge detecting sensor 31, a belt reference position detection signal from the belt reference position sensor 32, a control signal of a motor which drives the driving-side sprocket 45, and a control signal of the driving roller 49 is input to the controller 30.

The controller 30 is also made capable of controlling a motor 12 which drives the driving roller 3 and the Sirocco fan 11.

Above the suction box 8, the image forming unit 60 is provided which includes line type ink-jet heads (61*a*, 61*b*, 61*c*, 61*d*). These ink-jet heads are arranged along a horizontal direction orthogonal to the sheet transport direction and control jetting of the inks of colors, cyan, black, magenta, and yellow onto the upper surface of a sheet-like object S. An arrangement is made such that this image forming unit 60 is also driven and controlled by the above-mentioned controller 30. In fact, the above-mentioned controller 30 performs an overall control of the ink-jet printer including the sheet-like object transporting device, not only controlling the sheet-like object transporting device 1. Depiction and description of parts relevant to the ink-jet printer other than the image forming unit are omitted.

Whenever a process of transporting a sheet-like object S has finished, the controller 30 returns the transport belts 5 to a reference position (home position) by using a belt reference position detection signal which is output by the belt reference position sensor 32 and driving the motor 12 accordingly. This reference position is a position defined to align the downstream edge (i.e. the forward edge) of a sheet-like object S which is transported from the upstream side with the downstream edges of the open zones 6 of the transport belts 5.

When one sheet-like object is carried in by the sheet feeder 40 and its forward edge comes to the forward edge detecting sensor 31, a sheet detection signal is input from the forward edge detecting sensor 31 to the controller 30. Using this sheet detection signal as timing signal, the controller 30 predicts timing when the sheet-like object S is carried in a predetermined position in the sheet-like object transporting device 1 and drives the motor 12 and the Sirocco fan 11. By this, control is performed to start transportation in a state in which the forward edge of the sheet-like object S aligns with the forward edges of the open zones 6 and continue the transportation in a state in which the sheet-like object S covers over the open zones 6.

While control of driving the transport belt 5 by the motor 12 must be performed in time when a sheet-like object S is carried in, the operation of the Sirocco fan 11 may be started somewhat before a sheet-like object is carried in to allow for time to stabilize suction of the sheet-like object.

As a sheet-like object S is transported by the sheet-like object transporting device 1, the image forming unit 60 jets the inks of the respective colors in sync with a sheet transporting operation and forms a desired image (e.g., printing a production area or trademark among others) on the surface of the sheet-like object. Sheet-like objects S, after an image is formed on them, are stacked one by one in a stocker provided in the downstream side, which is not depicted.

Figure 6C:
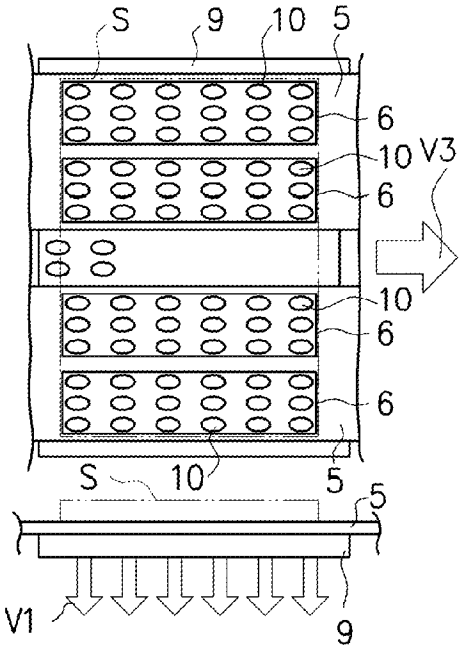
FIG. 6C is a schematic diagram explaining workings of how the sheet-like object transporting device of the first embodiment transports a sheet-like-object.
Figure 6B:
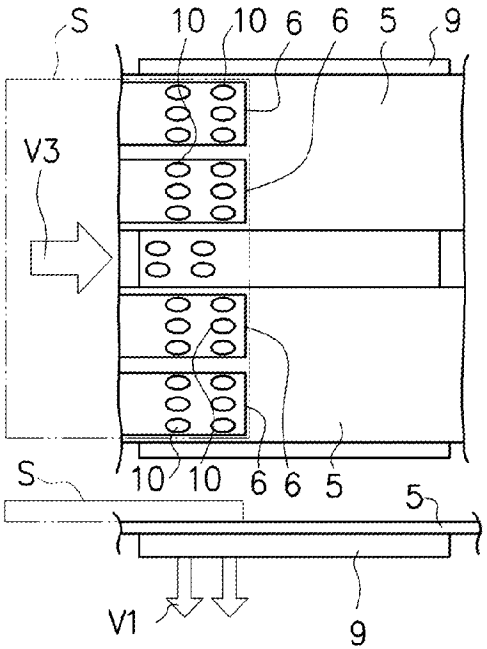
FIG. 6B is a schematic diagram explaining workings of how the sheet-like object transporting device of the first embodiment transports a sheet-like-object.
Figure 6A:
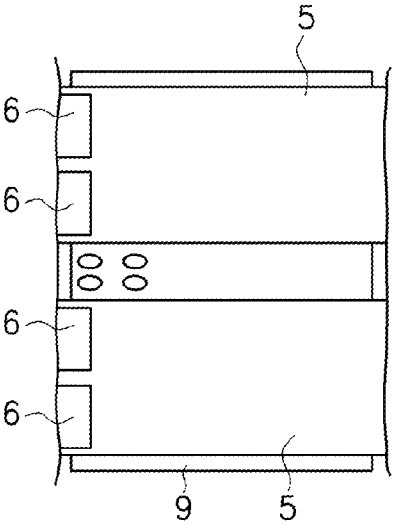
FIG. 6A is a schematic diagram explaining workings of how the sheet-like object transporting device of the first embodiment transports a sheet-like-object.

Then, referring to FIGS. 6A, 6B, and 6C, descriptions are provided about workings of how the sheet-like object transporting device 1 of the first embodiment transports a sheet-like-object S.

According to the sheet-like object transporting device 1 of the present embodiment, because the transport belts 5 are formed to have a width corresponding to the width of a sheet-like object S, if suction holes 10 of the transport plate 9 are covered by a portion of the transport belts 5 without the open zones 6, the suction holes 10 are closed up and put in a state in which they cannot suck in air. However, the open zones 6 of the transport belts 5 come to lie over the transport plate 9, the suction holes 10 which are present within the open zones 6 are exposed upward and can suck in air. Because the open zones 6 have a form corresponding to a sheet-like object S, a sheet-like object, if placed over the zones, can close up the open zones 6 without gaps.

Therefore, when the sheet-like object transporting device 1 transports a sheet-like object S, the sheet-like object S is carried in and placed on the transport belts 5 so as to close up the open zones 6. At the same time, air suction through the suction holes 10 of the transport plate 9 into the suction box is started by controlling the Sirocco fan 11 and the transport belts 5 are moved in the transport direction by controlling the motor 12.

FIG. 6A exemplifies a state in which the transport belts 5 are set in the reference position (home position). That is, in this state, the forward edges of the open zones 6 are set in a predetermined position so that the forward edge of a sheet-like object S which is coming in will align with the forward edges of the open zones 6 of the transport belts 5. The transport belts 5 are set in the reference position and stand by for coming-in of a sheet-like object S from a preceding process.

FIG. 6B depicts a state just after the device starts attracting and transporting a sheet-like object S by driving the motor 12 and the Sirocco fan 11 at appropriate timing after receiving the sheet-like object S on the transport belts 5 which stand by in the reference position (home position) in a mutual positional relation described above. Although the Sirocco fan 11 can be actuated somewhat early as described previously, it is desirable to actuate it at the same time when control is exerted to drive the motor 12 for energy saving purposes.

FIG. 6C depicts a state in which the entire sheet-like object S has covered over the open zones 6 of the transport belts 5, as the transport belts 5 move further. In this state, the sheet-like object S is attracted to the open zones 6 of the transport belts 5 and stably held onto the transport belts 5, contacting the belts without misalignment. The sheet-like object S can be stably transported with the move of the transport belts 5 without moving out of position or upward. Suction holes 10 other than the suction holes 10 which are used to hold the sheet-like object S onto the transport belts 5 are closed up by the transport belts 5. Thus, it is avoided that the suction force of the Sirocco fan 11 is used wastefully.

Upon completion of transportation, the transport belts 5 are further moved in the same direction and returned to the reference position. After transporting one sheet-like object S, when driving of the motor 12 is stopped, driving of the Sirocco fan 11 is stopped at the same time.

As just described, according to the present embodiment, the open zones 6 of the transport belts 5 are closed recesses surrounded by continuous outer peripheries and configured in a form that is slightly smaller than and substantially similar to a sheet-like object. Accordingly, if a sheet-like object S covers over the open zones 6, the open zones 6 are put in a completely closed up state. Therefore, air suction through the suction holes 10 in this state causes a sheet-like object S to contact the transport belts 5 and seal the open zones 6 and this can make the suction force through the suction holes 10 within the open zones 6 act on the sheet-like object S effectively.

If, especially, a sheet-like object S is highly stiff like a corrugated fiberboard as mentioned previously, the sheet-like object S covering over the open zones 6 is hard to deform even when it is exposed to suction from the suction box 8. If the height of the insides of the open zones 6, namely, the thickness of the transport belts 5 is, e.g., 2 to 3 mm, as mentioned previously, the above sheet-like object S hardly enters a space with the height of 2 to 3 mm. Thus, the spaces inside the open zones 6 of the transport belts 5 are put in a negative pressure state as air chambers and negative pressure whose magnitude depends on the volumes of the spaces is generated, which strongly attracts the sheet-like object S toward the suction box 8 and can make the sheet-like object S contact the surface of the transport plate 9 in the peripheries of the open zones 6 without gaps.

As just described, in the sheet-like object transporting device of the present embodiment, during suction by which a sheet-like object is attracted onto the transport belts 5, air leakage is small and efficiency is high. Thus, the required output of the Sirocco fan 11 is smaller than a similar device of related art which transports a sheet-like object held by suction. Even if the sheet-like object transporting device 1 of the present embodiment transports a sheet-like object S that is large and highly stiff, e.g., like a corrugated fiberboard of AO size, the Sirocco fan 11 with a small output, e.g., on the order of 30 W will work sufficiently.

More specifically, according to the present embodiment, the action of making a sheet-like object S contact and held onto the transport belts 5 by suction is reliable and it is possible to transport a sheet-like object S stably. The suction force of the suction unit can be used more effectively in a more economical manner. Moreover, by applying the present device to an ink-jet printer, as depicted FIG. 5 in the foregoing context, a trouble can be eliminated that a sheet-like object moves out of position, causing misalignment of an image that is printed on it or that a sheet-like object moves upward and collides with and damages an ink-jet head. Because the open zones of the transport belts are covered by a sheet-like object, splashing (misting) of traces of ink during printing due to air suction is diminished and a trouble that peripheral components are smudged with ink can also be remedied.

2. Second Embodiment

Figure 7A:
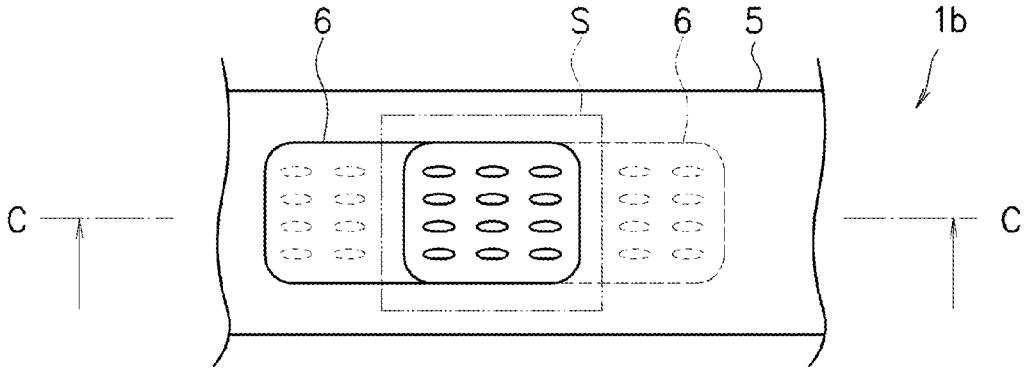
FIG. 7A is a plan view of a sheet-like object transporting device of a second embodiment.
Figure 7B:
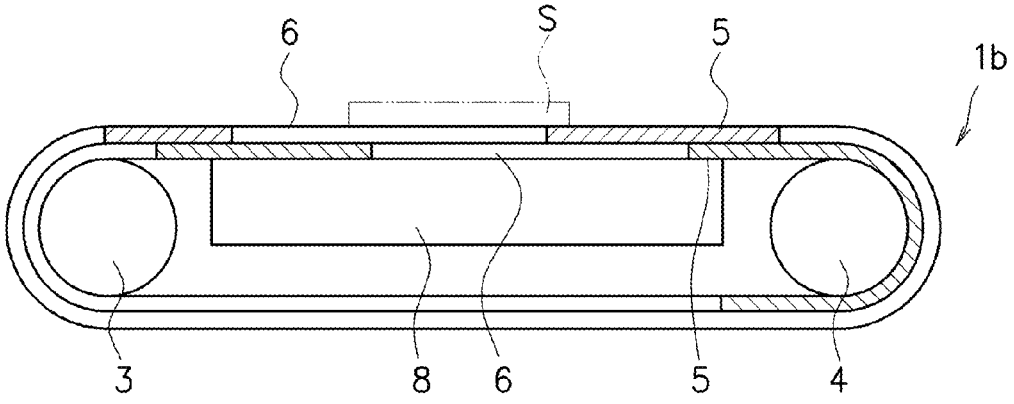
FIG. 7B is a cross-sectional diagram through section line C-C in FIG. 7A.
Figure 8B:
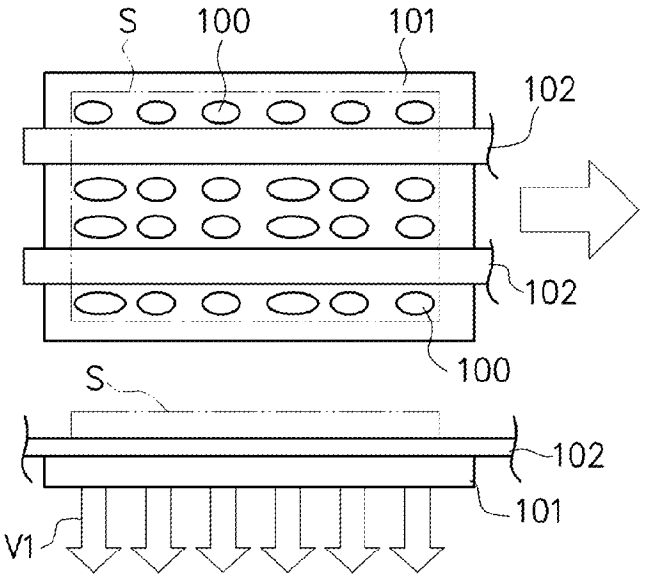
FIG. 8B PRIOR ART
FIG. 8B is a schematic diagram explaining the structure of a suction-type sheet-like object transporting device of related art and workings of how it transports a sheet-like object.
Figure 8A:
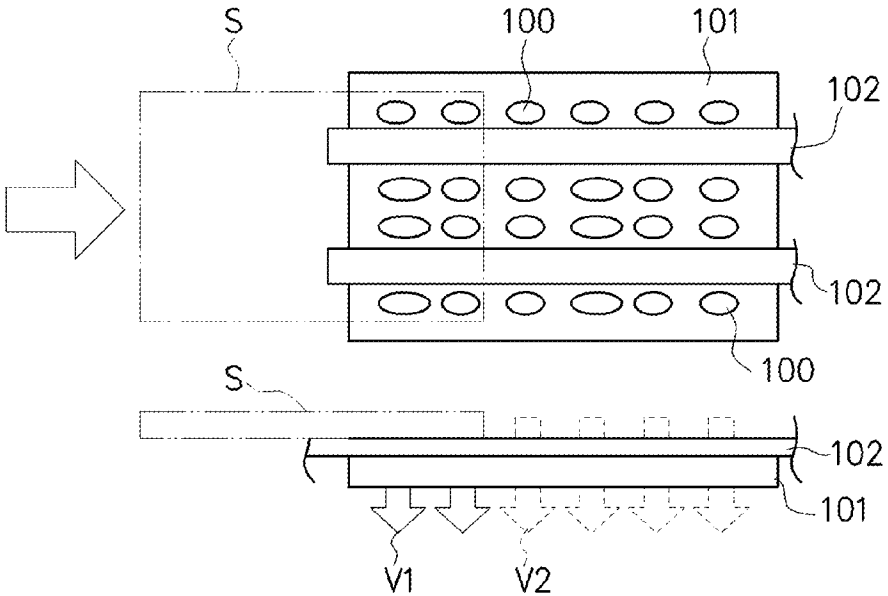
FIG. 8A PRIOR ART
FIG. 8A is a schematic diagram explaining the structure of a suction-type sheet-like object transporting device of related art and workings of how it transports a sheet-like object.

FIGS. 7A and 7B

A sheet-like object transporting device 1*b* of a second embodiment of the present invention is described with reference to FIGS. 7A and 7B.

In the sheet-like object transporting device 1*b* of the second embodiment, transport belts 5 and open zones 6 are configured differently from those in the first embodiment. Other parts are substantially the same as those in the first embodiment and, therefore, the descriptions about those parts in the first embodiment should be referred to.

As depicted in FIGS. 7A and 7B, the transport belts 5 of the present embodiment are two transport belts which are put one on top of the other, which mainly differs, are stretched between the driving roller 3 and the driven roller 4. In this respect, the transport belts 5 mainly differ from those in the first embodiment. One transport belt has one open zone as a matter of convenience in FIGS. 7A and 7B, whereas one transport belt has two open zones in the belt width direction for the transport belts of the first embodiment. A mechanism in which the belt tension is adjusted by the tension roller 20 is also omitted from depiction.

Depending on the difference in the positions of the two transport belts 5 in a circumferential direction, the positions of the respective open zones 6 of the two transport belts 5 in the circumferential direction differ and, thus, the degree to which both open zones 6 overlap will differ. Therefore, by adjusting the positions of the two transport belts 5 in the circumferential direction according to the dimensions of a sheet-like object S to be transported in the transport direction, it is possible to adjust the length of a section in which the two open zones 6 extend continuously in the transport direction in the two transport belts 5. After this adjustment work is done, both transport belts 5 may be fixed by a suitable fixing means so that a mutual positional relation of the transport belts 5 does not change.

As another means for enabling adjustment of the length of the open zones 6 of the transport belts 5 in the transport direction, in a sheet-like object transporting device provided with one transport belt 5 having one open zone 6 as in the first embodiment 1, a removable film may be attached to a part of the open zone 6. In this way, it is also possible to adjust the length of the open zones 6 of the transport belts 5 with respect to the transport direction according to the dimensions of a sheet-like object S to be transported in the transport direction.

The present invention is not limited to only the embodiments described hereinbefore and, in an implementation phase, components can be modified in various ways and incorporated without departing from the scope of the present invention. For example, the image forming unit 60 in FIG. 5 may be configured to use serial type ink-jet heads, not the line type. In the sheet-like object transporting device depicted in FIGS. 1 to 4, a single wide-width transport belt 5 can also be used without providing the bridge portion; in this case, however, the strength of the belt must be increased. By an appropriate combination of multiple components disclosed in the foregoing embodiments, diverse variations of the present invention can be formed. For example, some components may be deleted from all components that are presented in an embodiment.

Below is a list of reference signs in the figures.

1, 1*b* . . . Sheet-like object transporting device
5, 5*a* . . . Transport belt
6, 6*a* . . . Open zone
8 . . . Suction box as a suction part
9 . . . Transport plate
10 . . . Suction hole
11 . . . Sirocco fan as a suction means
12 . . . Motor as a driving unit
30 . . . Controller
31 . . . Forward edge detecting sensor
32 . . . Belt reference position sensor
S . . . Sheet-like object

The invention claimed is:

1. A sheet-like object transporting device that transports a sheet-like object, comprising:

a transport plate having a plurality of suction holes made penetrating therethrough;

a suction unit that is provided beneath the transport plate and sucks in air through the plurality of suction holes;

a transport belt that is provided so as to be movable along an upper surface of the transport plate and has one open zone in a circumferential direction of the transport belt, the open zone having a length corresponding to that of the sheet-like object;

a driving unit that moves the transport belt along the upper surface of the transport plate in a sheet transport direction; and a controller that controls the driving unit so that the sheet-like object is transported in a state in which the sheet-like object covers over the open zone.

2. The sheet-like object transporting device according to claim 1, wherein at least two transport belts are arranged in parallel with the sheet transport direction depending on a width of the sheet-like object, each transport belt having at least one open zone formed in parallel with the sheet transport direction, and the device as a whole having two or more open zones; and wherein a width of an open zone region covering over the two or more open zones is set to correspond to the width of the sheet-like object.

3. The sheet-like object transporting device according to claim 2, wherein a length of the open zones of the transport belts in the sheet transport direction is adjustable.

4. An ink-jet printer comprising an ink-jet head which prints on an upper surface of the sheet-like object, provided in a path along which the sheet-like object is transported by the sheet-like object transporting device of claim 1.

5. An ink jet printer comprising an ink-jet head which prints on an upper surface of the sheet-like object, provided in a path along which the sheet-like object is transported by the sheet-like object transporting device of claim 2.

6. An ink-jet printer comprising an ink-jet head which prints on an upper surface of the sheet-like object, provided in a path along which the sheet-like object is transported by the sheet-like object transporting device of claim 3.

7. A sheet-like object transporting device for transporting a sheet-like object, comprising:

a transport plate having a plurality of suction holes arranged along one direction thereof to penetrate therethrough;

a suction unit provided beneath the transport plate, for sucking air through the plurality of suction holes;

a transport belt provided movably along the one direction on an upper surface of the transport plate, and having one opening with a length corresponding to that of the sheet-like object to penetrate through the transport belt;

a driving unit moving the transport belt along the upper surface of the transport plate in the one direction; and a controller controlling the driving unit to transport the sheet-like object, wherein the plurality of suction holes are arranged in the transport plate under the transport belt so that when the transport belt is rotated while the suction unit sucks air through the plurality of suction holes, the one opening gradually uncovers the plurality of suction holes along a movement of the transport belt to attract the sheet-like object toward the transport plate through the one opening and the plurality of suction holes and to transfer the sheet-like object through the transport belt.

8. The sheet-like object transporting device according to claim 7, further comprising:

another transport belt provided movably along the upper surface of the transport plate in parallel to the transport belt and having another opening with a length corresponding to that of the sheet-like object;

wherein the transport plate further comprises a plurality of suction holes arranged under the another transport belt, and a plurality of another suction holes on an upstream side of the transport plate between the transport belt and the another transport belt for suctioning a leading end of the sheet-like object until a suction through the openings of the transport belt and the another transport belt become stable to transport the sheet-like object.

* * * * *